US008354798B2

(12) United States Patent
Redjebian

(10) Patent No.: US 8,354,798 B2
(45) Date of Patent: Jan. 15, 2013

(54) COMPENSATION CIRCUIT FOR CURRENT PEAKING REDUCTION IN NOTIFICATION APPLIANCES

(75) Inventor: Berj Redjebian, Laval (CA)

(73) Assignee: SimplexGrinnell LP, Westminster, MA (US)

( * ) Notice: Subject to any disclaimer, the term of this patent is extended or adjusted under 35 U.S.C. 154(b) by 191 days.

(21) Appl. No.: 13/005,704

(22) Filed: Jan. 13, 2011

(65) Prior Publication Data

US 2012/0181942 A1 Jul. 19, 2012

(51) Int. Cl.
*H05B 37/02* (2006.01)

(52) U.S. Cl. ..... 315/240; 315/120; 315/307

(58) Field of Classification Search ..... 315/120, 315/291, 307, 308, 227 R, 240, 119, 224, 315/241 R, 242
See application file for complete search history.

(56) References Cited

U.S. PATENT DOCUMENTS

| | | | | |
|---|---|---|---|---|
| 5,371,444 | A * | 12/1994 | Griffin | 315/291 |
| 5,977,725 | A * | 11/1999 | Miyazaki et al. | 315/291 |
| 6,861,812 | B2 * | 3/2005 | Kambara et al. | 315/291 |
| 7,006,003 | B2 | 2/2006 | Zimmerman et al. | |
| 7,369,037 | B2 | 5/2008 | Piccolo, III et al. | |

* cited by examiner

*Primary Examiner* — David H Vu
(74) *Attorney, Agent, or Firm* — Kacvinsky Daisak pllc

(57) ABSTRACT

A system and apparatus to reduce current peaking in notification appliances are described. The apparatus may include a current peaking compensation circuit comprising two or more transistors and one or more capacitors configured to reduce a start-up frequency of a pulse-width modulated signal during a first time period and to add a time constant decaying voltage across a resistor divider network to increase a reference voltage during the first time period. Other embodiments are described and claimed.

17 Claims, 17 Drawing Sheets

COMPENSATION CIRCUIT FOR CURRENT PEAKING REDUCTION IN NOTIFICATION APPLIANCES

FIELD OF THE INVENTION

Embodiments of the present disclosure relate to compensation circuits for current peaking reduction. More particularly, the present disclosure relates to compensation circuits for reducing current peaking in current controlled pulse-width modulation (PWM) circuits for notification appliances such as those used in fire alarm systems.

DISCUSSION OF RELATED ART

Visual notification appliances, e.g. warning lights, are often used within buildings in conjunction with audio warning alarms so that the hearing impaired can be alerted to emergency conditions such as a fire. Typically, the visual notification appliance includes a flashing bulb or strobe positioned within a reflector. The bulb receives power from a power supply in a control panel. This power supply is normally powered by the building's AC supply, but also provides battery backup to ensure that the visual notification appliance will have power in the event power to the building is disrupted.

Visual notification appliances are subject to light intensity requirements as specified in various standards, such as Underwriters Laboratories UL 1971 (as well as UL 1638), "Standard for Safety Signaling Devices for the Hearing Impaired," and the National Fire Protection Association's NFPA 72, The National Fire Alarm Code, all of which are incorporated herein by reference in their entirety.

The flash bulb or strobe of a visual notification appliance may be made up of a high-intensity xenon flash tube, a reflector assembly, a transparent protective dome, an electronic control circuit, a terminal block and a housing to accommodate installation of the device to a wall or ceiling. In various embodiments, the strobe of a visual notification appliance is designed to disperse its light output in a hemispherical pattern. The light distribution must meet the stringent specifications for UL approval, and it typically must accurately flash at a specified rate, for example, once per second or at some other multiple. Strobes in the same viewing area typically must be synchronized, as a fast flash rate or several unsynchronized strobes at the normal rate could cause susceptible people to have epileptic seizures.

The required intensity of the strobe, measured in candela, is dependent on occupancy, location, and local and national codes, standards and guidelines. For example, a strobe that is in a sleeping area and is required to wake the occupants is required to output more candela than a strobe located in a hallway. Notification appliances may include visual notification elements and audio notification elements. In various embodiments, however, the visual notification elements may draw more current than the audio notification elements. Each visual notification appliance may draw between 3 W-6 W of power, depending on the intensity of the light being emitted. The intensity of light may range from 15 candela to 185 candela, for example.

These notification appliances are connected to one or more central panels to define a notification system. The panels are used to control and provide regulated power to the plurality of notification appliances which are seen by the panel as a constant DC load for a given output voltage. For example, notification appliances may be designed to behave as a DC current load (e.g. RMS to DC variation is approximately on the order of 10-20% while the AC current/switching current/current interruption behavior is approximately less than 6-8%). This may be because current peaking may culminate in the addition of unwanted surge current when a number of notification appliances are populated and synchronized.

Efforts may be made to reduce current surges when peaking occurs using a regulated power supply or other means, including mechanisms using soft-start current limitation in the loads (e.g., notification appliances) upon start-up, or using current limiting circuits during repetitive start-up, or slow-charging smoothing circuits through specific requirements of UL1971. Despite these efforts, significant current peaking may still occur early and unintentionally in the notification appliance circuits in its steady-state operation. This phenomenon may be specific to the nature of the PWM circuit despite the fact that they incorporate current regulation. Although current peaking in these circuits may lead to shorter turn-on times for the notification appliances, the remnant charge for each duty cycle must be discharged before the next PWM cycle occurs.

In traditional PWM regulators where current-mode power supplies regulate voltage output, slope compensation may be used to control current peaking relating to wide duty cycle variation. In this example, to maintain a constant average current independent of duty cycle, a compensation circuit may be used, whereby, with increasing duty cycle the current regulation threshold is decreased in a descending slope, which may be referred to as slope-compensation. However, this application may not be suitable for flash tube constant-current PWM regulators that only regulate current. As a result, any form of compensation may not only distort input current waveforms and remove regulator control, but may also affect the net amount of energy delivered to a discharge (load) capacitor on a cycle-per-cycle basis.

Unlike most boost topology circuits that regulate output supply voltage, strobe notification circuits do not regulate output voltage but rather store charge through a constant-current cycling process. While the input characteristics may behave as a DC load, the output voltage is charged up exponentially over a period of approximately 1 second. The resultant behavior of the charge time is defined for a boost-circuit as follows:

$$t_{(on)}=[(V_{out}-V_{in})*t_{(off)}]/V_{in}$$

The output voltage in a strobe flash tube charge cycle may vary anywhere from its start-up voltage $16<V_{in}<33$ Volts to a voltage that may vary anywhere from $140<V_{out}<320$ Volts, depending on strobe flash tube energy requirements (e.g., Candela settings). This may result in a 20:1 variation in turn-on ($t_{on}$) time when compared to a turn-off cycle ($t_{off}$) that may vary 2:1. Because many PWM circuits are substantially constant-frequency devices, the high duty cycle variation combined with the somewhat lesser turn-off duty variation may push the PWM circuit to function in and out of non-continuous mode. Even when a PWM is well designed and toleranced for a given application where the duty cycle variation is high, there is still a possibility that with narrow dead-time (e.g., substantially no inductor cycling turn-on or turn-off) the magnetic remanence may maintain a residual flux that may end-up causing peak currents. For example, in the initial phases where the ($t_{cycle}=t_{turn\text{-}on}+t_{turn\text{-}off}$) time is very high, dead time may become very minimal which may result in a build-up of magnetic flux that does not get fully discharged. This build up may affect efficiency and may also draw extra current that does not translate into extra output. Consequently, it may be desirable to implement a circuit to compensate for, or reduce, current peaking in notification appliances. Therefore, the implemented mechanisms may adjust the dead time by maintaining it quasi-constant by reducing the switching frequency lower during the start-up period.

SUMMARY OF THE INVENTION

Exemplary embodiments of the present disclosure may be directed to a current peaking compensation circuit comprising two or more transistors and one or more capacitors configured to reduce a start-up frequency of a pulse-width modulated signal during a first time period and to add a time constant decaying voltage across a resistor divider network to increase a reference voltage during the first time period.

Various embodiments may also be directed to a notification appliance comprising one or more optical elements, an optical element driving circuit and a current peaking circuit. In some embodiments, the optical element driving circuit may be configured to drive the one or more optical elements. The current peaking circuit may be configured to reduce the start-up frequency of a pulse-width modulated signal during a first time period to enable a substantially long cycle time to reset inductor flux by extending the dead-time in a constant current operation of the notification appliance in various embodiments.

Some embodiments may be directed to a system comprising one or more current regulated power supplies and a plurality of notification appliances. The one or more notification appliances may include one or more current peaking circuits that may be configured to reduce a start-up frequency of a pulse-width modulated signal during a first time period to enable substantially constant current operation of the one or more notification appliances in some embodiments. Other embodiments are described and claimed.

DESCRIPTION OF EMBODIMENTS

Figure 1A:
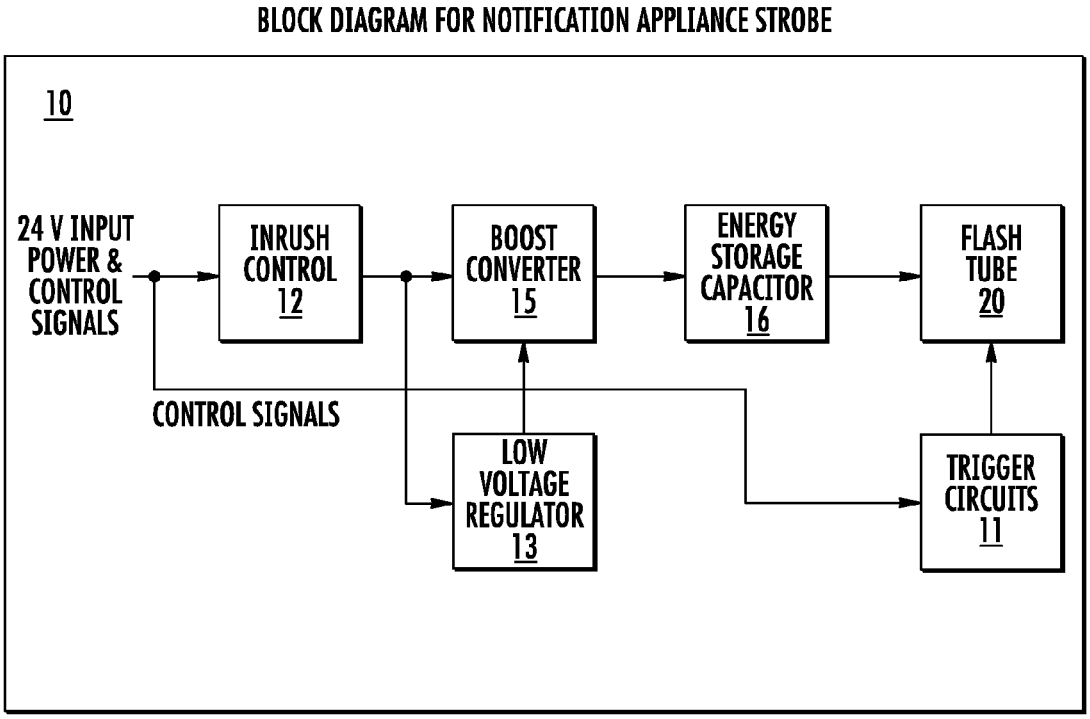
FIG. 1A illustrates a block diagram of an exemplary notification appliance.

The present disclosure will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Various embodiments may be generally directed to reducing current peaking in notification appliances. In one embodiment, for example, a current peaking compensation circuit may comprise two or more transistors and one or more capacitors configured to reduce a start-up frequency of a pulse-width modulated signal during a first time period and to add a time constant decaying voltage across a resistor divider network to increase a reference voltage during the first time period. In this manner, current peaking for notification appliances may be reduced and the notification appliances may operate using substantially flat, scalable, constant or otherwise predictable current. Other embodiments may be described and claimed.

FIG. 1A is a functional block diagram of a notification appliance 10 including an inrush control 12, a boost converter 15, an energy storage capacitor 16, and an optical output element or flash tube 20. The optical element may also be referred to herein as a load configured to provide the necessary candela for visual notification. An input voltage is applied to the inrush control 12 as well as to trigger circuits 11. The output of the inrush control 12 is supplied to low voltage regulator circuit 13 that supplies an input to boost converter 15.

Figure 1B:
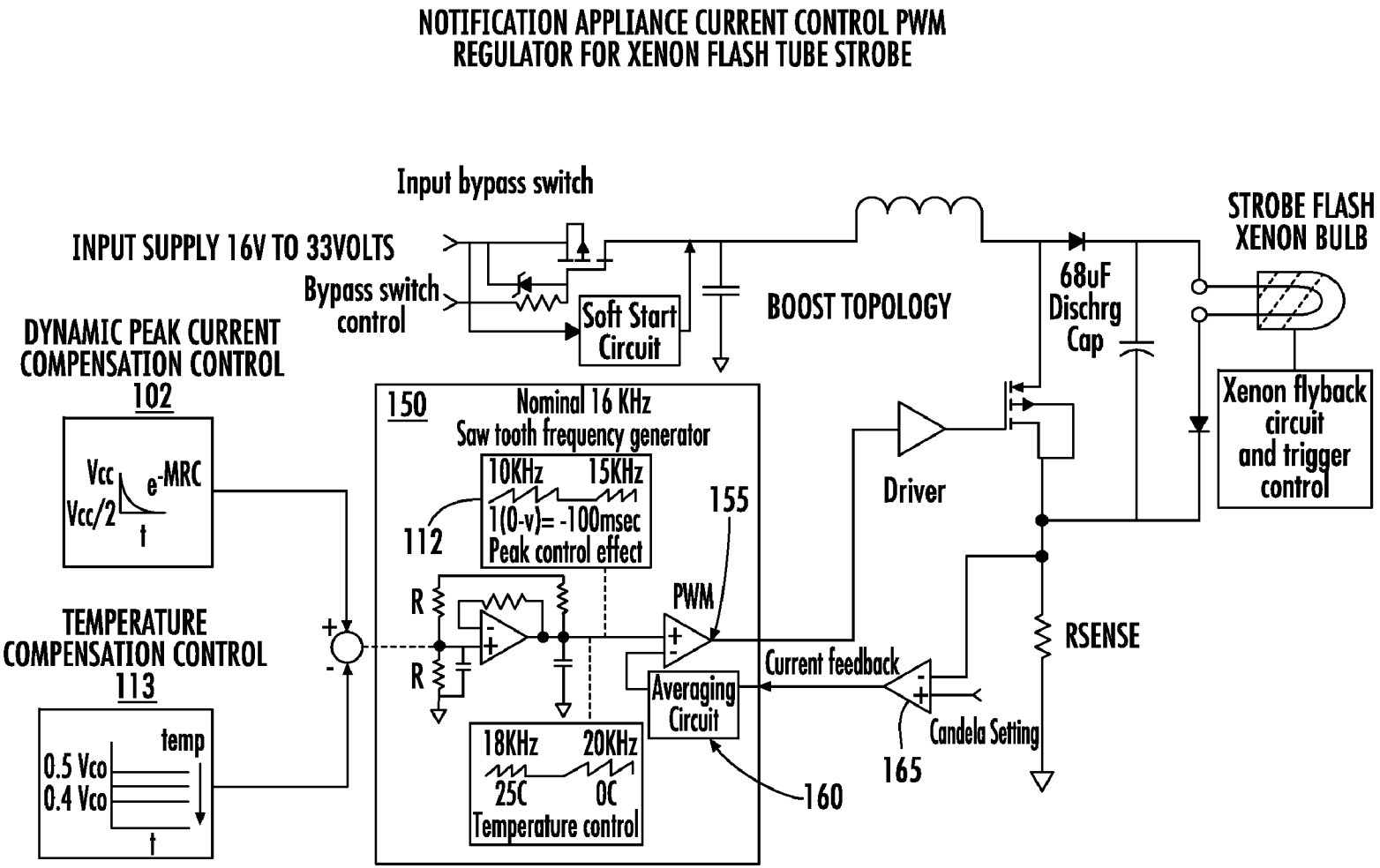
FIG. 1B illustrates a block diagram of the boost circuit shown in FIG. 1A used to drive a notification appliance having a Xenon Flash tube.

FIG. 1B is a schematic of a notification appliance current controlled PWM regulator circuit for a xenon flash tube strobe showing a more detailed view of boost converter 15 shown in FIG. 1A. This circuit is used to drive a notification appliance having a strobe flash Xenon bulb 114. The notification appliance current controlled PWM regulator circuit includes a dynamic peak current compensation control circuit 102, a temperature compensation control circuit 113 and a Pulse Width Modulation (PWM) current feedback regulator circuit 150 defined by an oscillator circuit 112 cascaded by a PWM feedback circuit including comparator 155, averaging circuit 160 and candela setting comparator 165. The oscillator circuit 112, through the use of a single comparator 155 defines a saw-tooth generator. The dynamic frequency compensation circuit 102 is used to modulate the start-up frequency by forcing it to operate at a lower frequency. The PWM current feedback regulator circuit is thus defined by oscillator (or saw-tooth generator) 112, PWM feedback circuit including comparator 155, averaging circuit 160, and candela setting comparator 165 as well as optionally including temperature compensation control circuit 113.

Temperature compensation circuit 113 may be utilized to boost power output by steadily increasing output frequency, as the ambient temperature decreases. The preferred embodiment takes into account the saw-tooth circuit network impedance along with the temperature-compensation circuit. The temperature compensation circuit is mentioned for the purpose of completeness of design implementation rather than describing the functionality or applicability of its effect. Therefore, the design inherently includes temperature compensation and all described material takes into account the network impedance of the temperature-compensation circuit. For simplicity and ease of explanation, it may be necessary to approximate network impedance of saw-tooth generator circuit 112 and temperature-compensation circuit 113 as a lumped equivalent circuit. The following analysis and discussion assumes operation at nominal ambient temperature of 25 degrees Celsius. This is done to simplify the analysis by eliminating any impedance variation due to the temperature compensation circuit 113.

Figure 2:
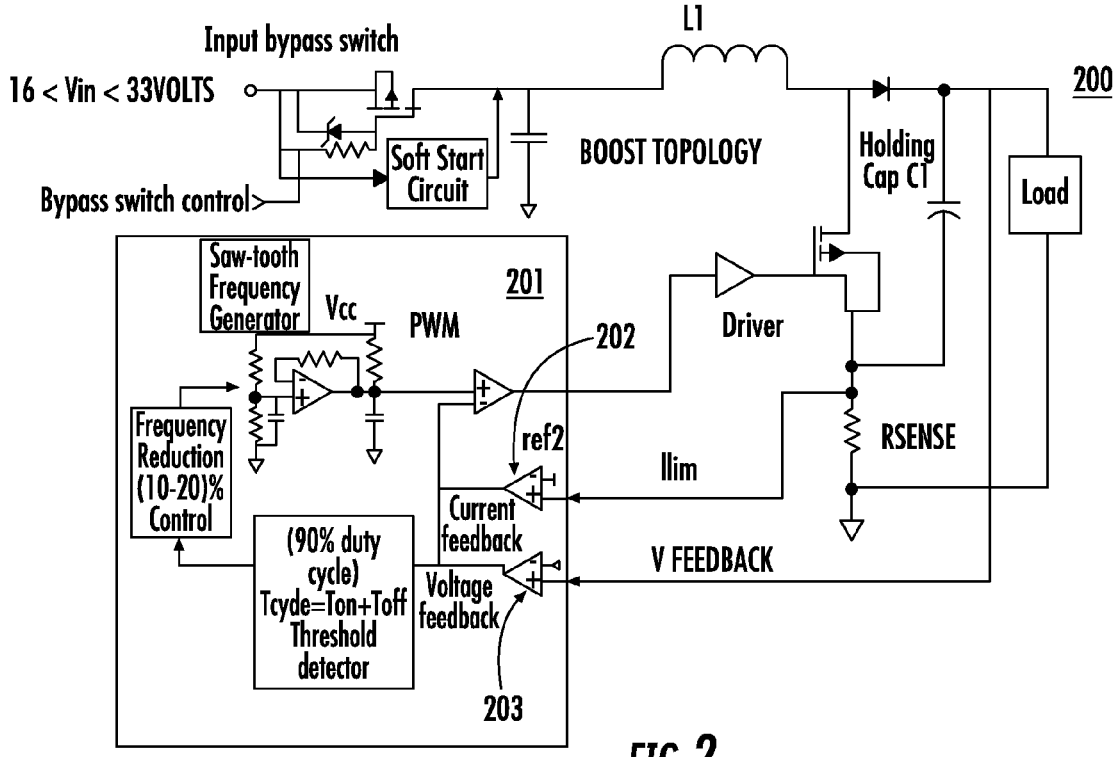
FIG. 2 generally shows an alternative embodiment of a boost power supply that is not configured to drive a notification appliance utilizing a Xenon Flash tube.

FIG. 2 illustrates a circuit 200 of general application for PWM regulators using current mode control that is not configured to drive a notification appliance utilizing a Xenon flash tube, but may be used for other applications in which peaking control in power supplies is needed. Circuit 200 includes a saw tooth frequency generator circuit 201 with a PWM portion having a current feedback portion using comparator 202 and a voltage feedback portion using comparator 203. As can be seen, the circuit of FIG. 2 does not utilize a dynamic peak current compensation circuit illustrated in FIG. 1B. However, circuit 200 does include an inductor L1 which charges holding capacitor C1 that, when fully charged, supplies power to the load turning on an optical element. The circuit 200 of FIG. 2 is used in general applications for PWM regulators using current mode control and will be referred to herein as a reference for comparison with the boost power supply that does drive a notification appliance utilizing a Xenon flash tube.

Figure 3:
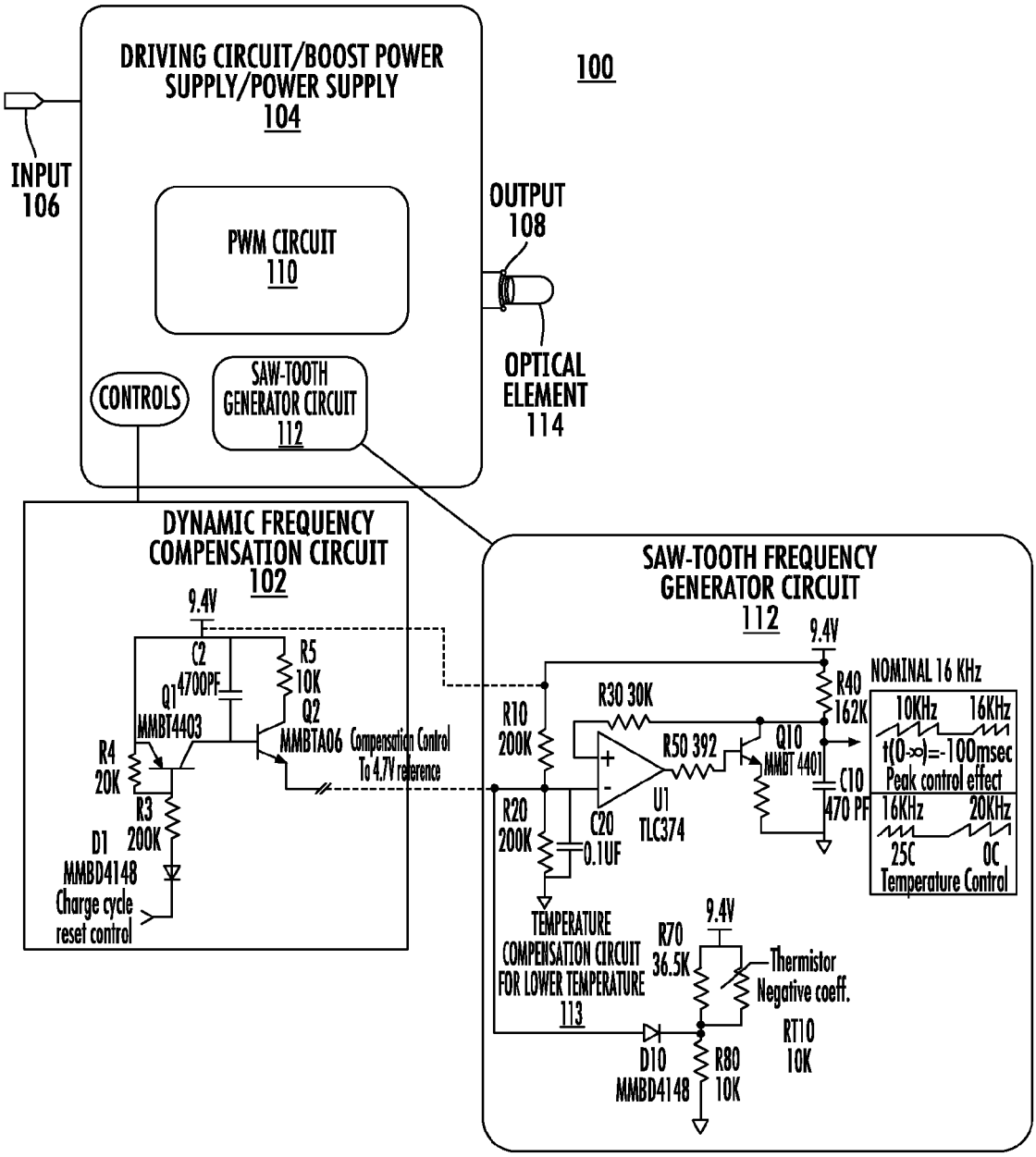
FIG. 3 is a schematic of a saw-tooth generator with the preferred embodiment of a dynamic frequency compensation circuit for peak current control during start-up.

FIG. 3 illustrates an embodiment of an exemplary notification appliance circuit 100 comprising multiple elements, such as dynamic frequency compensation circuit 102, driving circuit 104, input 106, output 108, PWM circuit 110, saw-tooth frequency generator circuit 112, temperature compensation circuit 113, optical element 114 and controls 120. Dynamic frequency compensation circuit 102 may be referred to interchangeably herein as current peaking compensation circuit 102 or current peaking circuit 102. The embodiments, however, are not limited to the elements or description of the elements shown in this figure.

Circuit 100 includes input 106 to receive power from a power supply configured to power notification appliance 100 or to drive an optical element 114 of the notification appliance circuit 100. For example, input 106 comprises an input from a current regulated power supply that forms part of a notification appliance network or control system. The power supply may be a building's AC supply or a battery backup to ensure that the visual notification appliance circuit 100 will have power in the event power to the building in which an installed notification system is disrupted. Circuit 100 may include output 108 having terminals or other connections suitable for accepting a strobe, bulb or other visual notification or optical element 114. The flash bulb or strobe 114 of visual notification appliance circuit 100 may comprise a high-intensity xenon flash tube.

Temperature compensation circuit 113 is an added scalable feature that is used to compensate for loss of light generated by optical element 114 at lower temperatures. It accomplishes increased power output by modulating the power supply frequency higher.

Circuit 100 may include driving circuit 104 that comprises a circuit or network arranged to drive, power or otherwise control a signal or supply at output 108 to illuminate a flash bulb for optical element 114. Driving circuit 104 may be referred to as a boost power supply or power supply and still fall within the described embodiments. Driving circuit 104 may include a PWM circuit 110 and a saw-tooth frequency generator circuit 112. While a limited number of components, elements or circuits are shown as part of driving circuit 104 in FIG. 3, it should be understood that any number, type and combination of circuit elements or components may be used to form driving circuit 104 and still fall within the described embodiments. Exemplary embodiments of a driving circuit are illustrated and described in more detail with reference to FIGS. 1B and 2.

PWM circuit 110 may comprise a portion of driving circuit 104 arranged to regulate or vary a duty-cycle of an input signal based on input voltage variation for a given constant output voltage. Duty cycle may refer to the combination of turn-on time and turn-off time of the optical element 114. The pulse-width modulated signal generated by PWM circuit 110 may be configured to periodically turn on and turn off optical element 114 of notification appliance circuit 100.

The construction of the saw-tooth frequency generator circuit 112 may comprise a portion of driving circuit 104 arranged to establish a resistor-capacitor (RC) circuit as an oscillator circuit that cycles through a ramp-up period dictated by the RC circuit defined by R40 and C10. By way of example, the approximate period may be T=ln(k1)RC, without elaborating other delay factors this is approximately equal to a period of 16 KHz. The slow ramp-up period is abruptly terminated by transistor Q10 which serves as a quick ramp-down circuit once the saw-tooth signal reaches its thresholds set by reference resistors R10 and R20 and filter capacitor C20. Resistors R10, R20 and capacitor C20 form part of the saw-tooth generator circuit 112. For example, the reference threshold voltage may comprise half of a regulated supply voltage. In one preferred embodiment, the supply voltage may comprise 9.4V and the saw-tooth generator reference voltage may comprise 4.7V. In this example, k1 which is the ratio of threshold reference to supply reference is equal to 4.7/9.4 volts. Should the reference threshold be modulated, this circuit serves as a Voltage-Controlled-Oscillator (VCO).

Controls 120 may comprise a module, circuit or other components arranged to control and electrically couple dynamic frequency compensation circuit 102 to driving circuit 104 as a non-linear VCO. Existing temperature compensation is used by varying the reference voltage lower with decreasing temperature to boost power output. In ambient temperature, the temperature compensation acts as an uncoupled network and is not brought into the analysis. The embodiments are not limited to this example. Hence the output frequency of the saw-tooth generator is a function of the threshold reference voltage. As this threshold is increased, a decreased PWM frequency output is expected.

In this manner, the circuit helps to reduce a start-up frequency of a pulse-width modulated signal during a first time period and to add a time constant decaying voltage across a resistor divider network to increase a reference voltage during the first time period for notification appliance circuit 100. The first time period may comprise a start-up time of the pulse-width modulated signal, such as a signal from PWM circuit 110 for example. The time constant decaying voltage may comprise an exponentially decaying voltage configured to decay from a rail or supply voltage to a reference voltage.

Dynamic frequency compensation circuit acts in conjunction with the reference threshold of the saw-tooth generator to get the desired frequency output. The circuit indirectly acts in conjunction with the temperature-compensation circuit and needs to be included in the equation in this analysis, either as a separate parallel network or as a lumped approximation with the saw-tooth resistor-divider network. The desired modulation of the reference voltage using dynamic frequency compensation for peak-current control, is an exponential decay of reference voltage $k1=0.5+0.5e^{-t/T}$. This is because the start-up cycle of the current regulator suffers the greatest increase in duty cycle time, i.e. sum of turn-on and turn-off time, which culminates in the smallest dead-time available for the PWM controller. This is where the dynamic frequency compensation circuit helps to increase PWM dead-time and helps to reduce residual flux of core, thereby considerably reducing current peaking.

Dynamic frequency compensation circuit or current peaking circuit 102 may comprise two or more transistors and one or more capacitors designed to behave as an active capacitor. The active capacitor circuit, when interfaced with the lumped divider circuits, acts as an exponential decay circuit. This exponential decay circuit saturates the reference thresholds to its maximum rail voltage upon enabling and decays to its steady-state reference voltage of 4.7 volts established by resistor-divider network R10 and R20, along with high frequency filtering capacitor C20, negative coefficient thermistor RT10, resistors R70 and R80, and diode D10 of the temperature compensation circuit. The decay period is dictated by the active (Hfe*C2) capacitor value and the lumped resistor value which depending on the decay of the dynamic curve will vary the equivalent resistor value $R_{eq}$(load)=10.5K and increase gradually to 200K. Therefore, the resultant time constant itself will vary at $t_0$=C2*Hfe*10.5K to t∞=C2*Hfe*200K. The collector resistor R5 adds further control to attenuate the amplitude of the start-up (saturated) reference voltage to a desired level. In this example the saturated reference voltage will be approximately $V_{ref}$=7 Volts.

As shown in FIG. 3, current peaking circuit 102 may include two transistors Q1 and Q2, capacitor C2, resistors R3, R4 and R5 and a diode D1. While a limited number and combination of circuit elements or components are shown for purposes of illustration, it should be understood that the embodiments are not limited in this context.

Transistor Q2 may be configured as a capacitance multiplier connection in an embodiment. For example, a gain of the first transistor Q2 may be multiplied by a capacitance of a first capacitor C2 coupled to the base of the first transistor to generate a time constant for the current peaking compensation circuit 102. In various embodiments, a high gain of the first transistor Q2 may allow for the selection of a relatively small capacitance value for first capacitor C2. For example, first capacitor C2 may comprise a 4700 pF capacitor in some embodiments. The relatively small capacitance of first capacitor C2 may allow for a desired time scale that would not otherwise be possible with a larger capacitor that will be required without the gain of first transistor Q2.

Current peaking circuit 102 comprises transistor Q1 that is configured to discharge the capacitor C2 at the beginning of the first time period of each flash cycle. For example, capacitor Q1 may discharge capacitor C2 to 9.4V. The collector of transistor Q1 is coupled to the capacitor C2 and the base of transistor Q2. In some embodiments, capacitor C2, transistor Q2 and resistor R5 may be arranged to act as a gain limiter to prevent or reduce initial surge current that may result from instantly charging filtering capacitor C20. It may also serve to attenuate the saturated voltage to a value less than 9.4 volts to approximately 7.0 volts, thus eliminating overcompensation of frequency output. The embodiments are not limited in this context.

The gate of the transistor circuit Q3, which comprises circuit elements R3, R4 and diode D1 are configured to switch on the capacitor C2 discharge circuit for a period of 30 msec at the beginning of the charge cycle. Diode D1 helps to reduce or eliminate reverse current that may be fed back to the control circuit elements present outside of the current peaking circuit 102.

In various embodiments, current peaking circuit 102 may be configured to non-linearly modulate the PWM signal such that a start-up frequency component of the signal is exponentially lowered or attenuated based on an RC time constant until a period for current peaking has passed, e.g. a first time period. Current peaking circuit 102 may utilize transistors Q1 and Q2 to accomplish this task, for example. PWM circuit 110 may function by generating a signal used by saw-tooth generator circuit 112 to establish a reference voltage comprising half of the regulated supply voltage, which may be dictated by the resistor divider network comprising R10, R20 and C20, in some embodiments.

Current peaking circuit 102 may be configured to add a RC time constant, decayed exponential voltage across the resistor divider network with the purpose of increasing the reference voltage during the first time period. The first time period may comprise the first 10 to 70 milliseconds of the PWM start cycle. For example, the decayed exponential voltage may decay exponentially from 9.4V to 4.7V in some embodiments.

The power supply point of regulation is found to be where the input voltage $V_{in}$ and output voltage $V_{out}$ may be substantially similar (e.g. near parity) which makes the first time period a time where a contribution to the PWM dead-cycle may be the most beneficial. This is because the power supply turn-on and turn-off times are the closest to parity, thus contributing to a maximum in cycle duration. Current peaking circuit 102 may be configured to utilize an active RC impedance network to multiply the RC time constant by the gain of the NPN transistor Q2 (Hfe). As a result, the active time constant circuit may be based on [Req*C2*Hfe] of the transistor, where $R_{eq}$ comprises the lumped load resistor and diode networks which itself varies dynamically within the decay curve. The $R_{eq}$ is a combination of resistors and diode networks in parallel. Resistor R20 of circuit 112 comprises a saw-tooth generator section, D10 and R80 of circuit 113 for temperature compensation. In its steady-state operation, Q2 acts like a buffer from saw-tooth reference voltage when dynamic compensation is no longer needed and this helps it uncouple the reference voltage divider network, R10, R20 and C20 in steady state operation.

Current peaking circuit 102 may comprise a module or modular circuit. For example, current peaking circuit may comprise a circuit that can be added to existing notification appliances or driving circuits with relative simplicity. In a preferred embodiment, the current peaking circuit 102 may be added to an existing notification appliance circuit with the slight requirement of adjusting the nominal operating frequency of the existing circuit by increasing it by approximately 2%. Other embodiments are described and claimed.

The increased efficiency achieved with the addition of the current peaking circuit is evidenced in the following Tables 1-4, illustrating example test results at different input voltage and candela levels for a notification appliance representing baseline measurements for a circuit without a current peaking compensation circuit (e.g. Baseline) and modulated measurements for a similar circuit employing a current peaking compensation circuit (e.g. Mod). As shown in Tables 1-4, the peak current for each circuit having a current peaking compensation circuit is reduced when compared to the baseline peak current measurements.

TABLE 1

| 16 V @ 15Cd | Voltage (V) | RMS Current (mA) | Peak Current (mA) |
|---|---|---|---|
| Baseline | 132 | 57.74 | 90 |
| Mod | 130 | 56.08 | 71.2 |

TABLE 2

| 33 V @ 15Cd | Voltage (V) | RMS Current (mA) | Peak Current (mA) |
|---|---|---|---|
| Baseline | 130 | 36.81 | 100 |
| Mod | 127.6 | 35.96 | 77.2 |

TABLE 3

| 16 V @ 185Cd | Voltage (V) | RMS Current (mA) | Peak Current (mA) |
|---|---|---|---|
| Baseline | 291 | 268 | 358 |
| Mod | 291 | 263.6 | 314 |

TABLE 4

| 33 V @ 185Cd | Voltage (V) | RMS Current (mA) | Peak Current (mA) |
|---|---|---|---|
| Baseline | 293 | 130.8 | 288 |
| Mod | 290 | 127 | 226 |

Figure 4A:
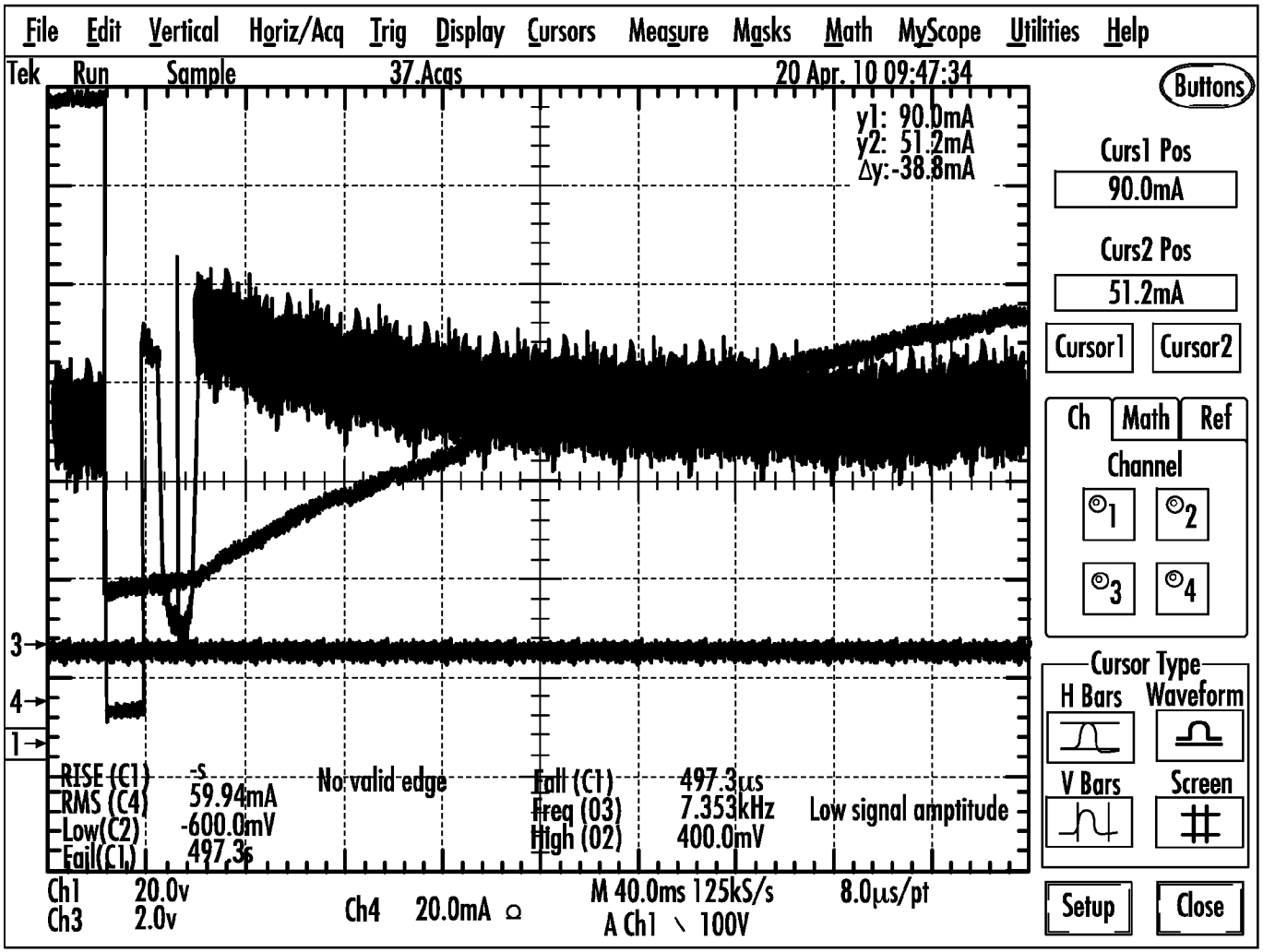
FIGS. 4-7 are waveforms illustrating the current peaking performance prior to and after the implementation of the current peaking control at various input voltages.
Figure 4B:
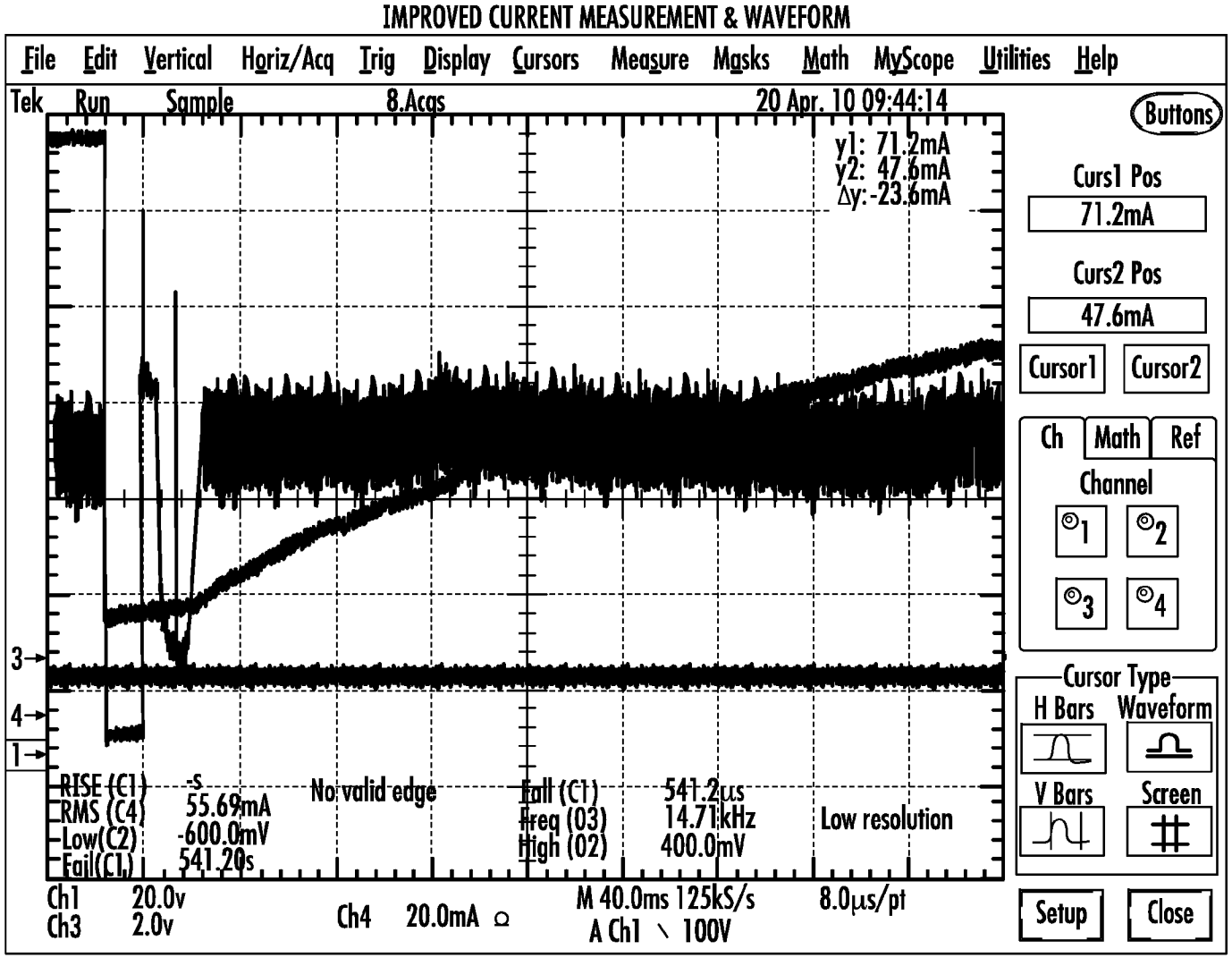
Figure 5A:
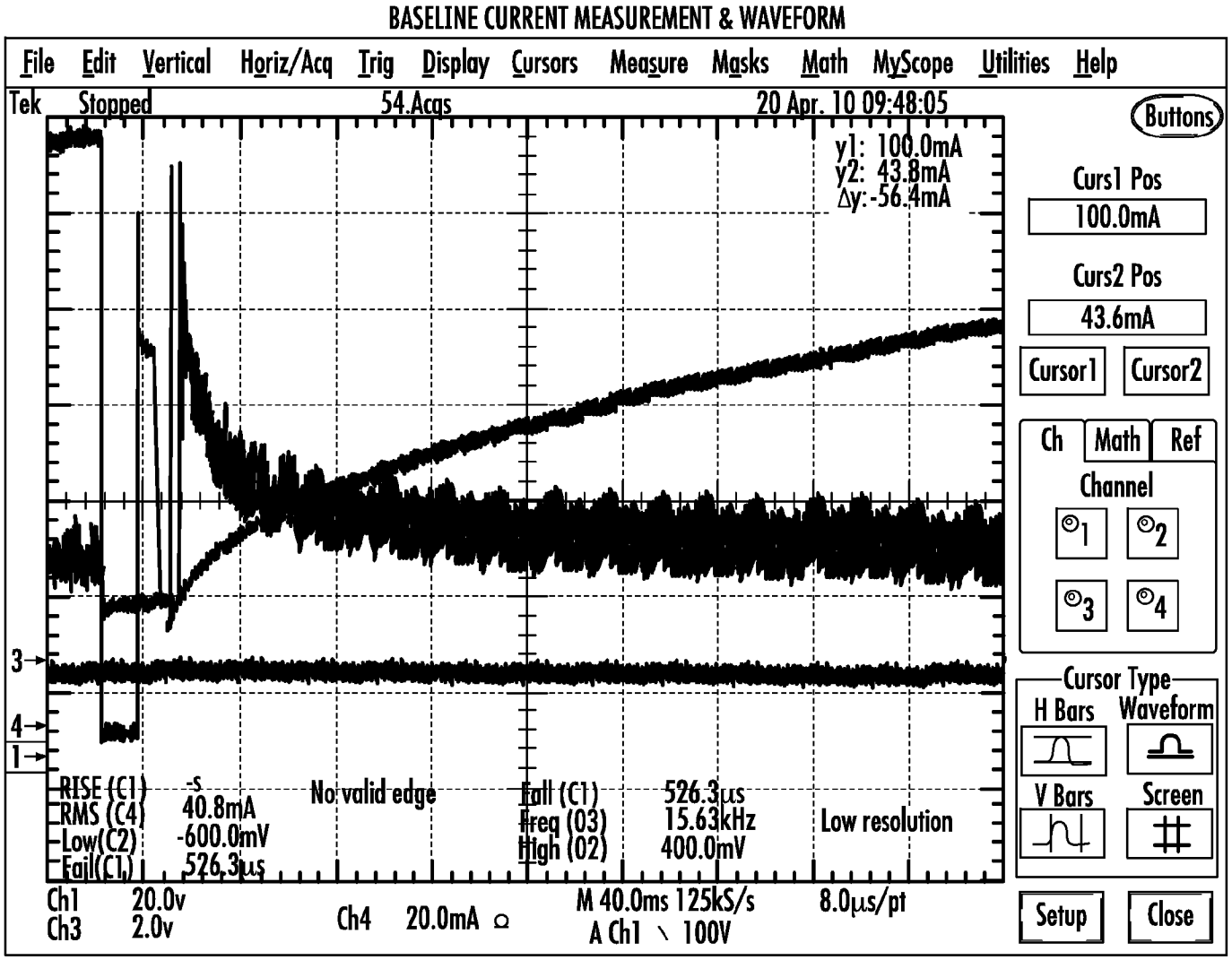
Figure 5B:
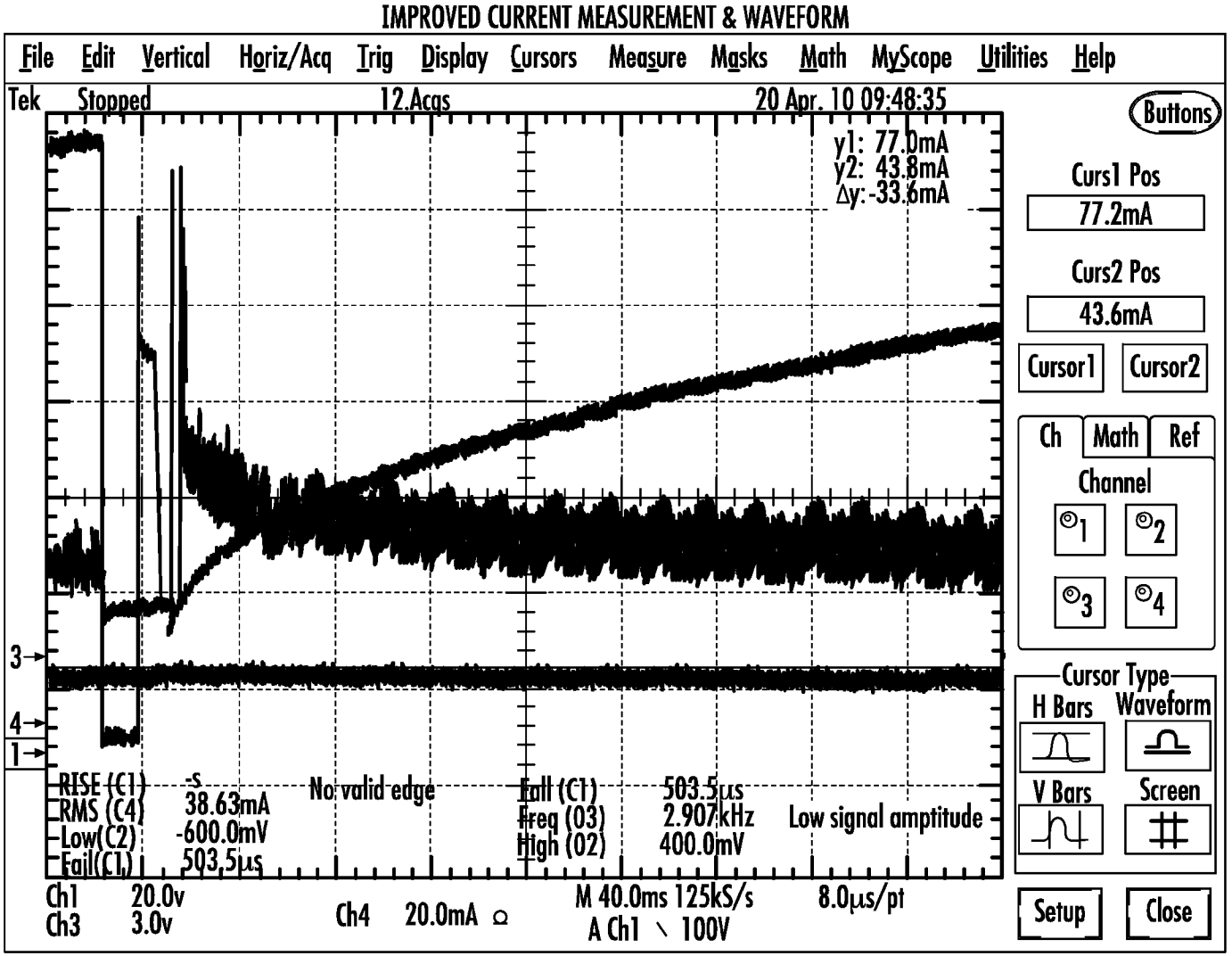
Figure 6A:
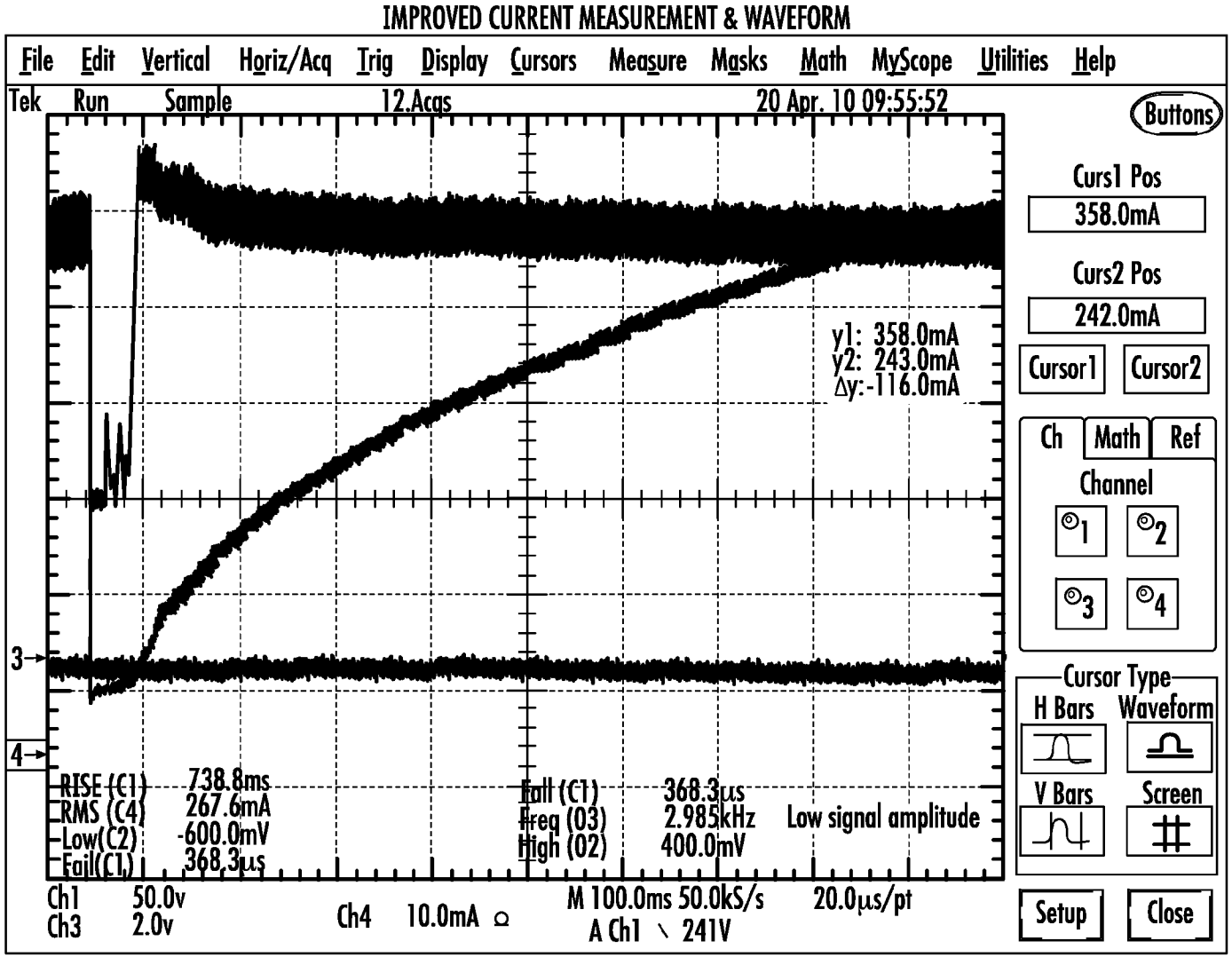
Figure 6B:
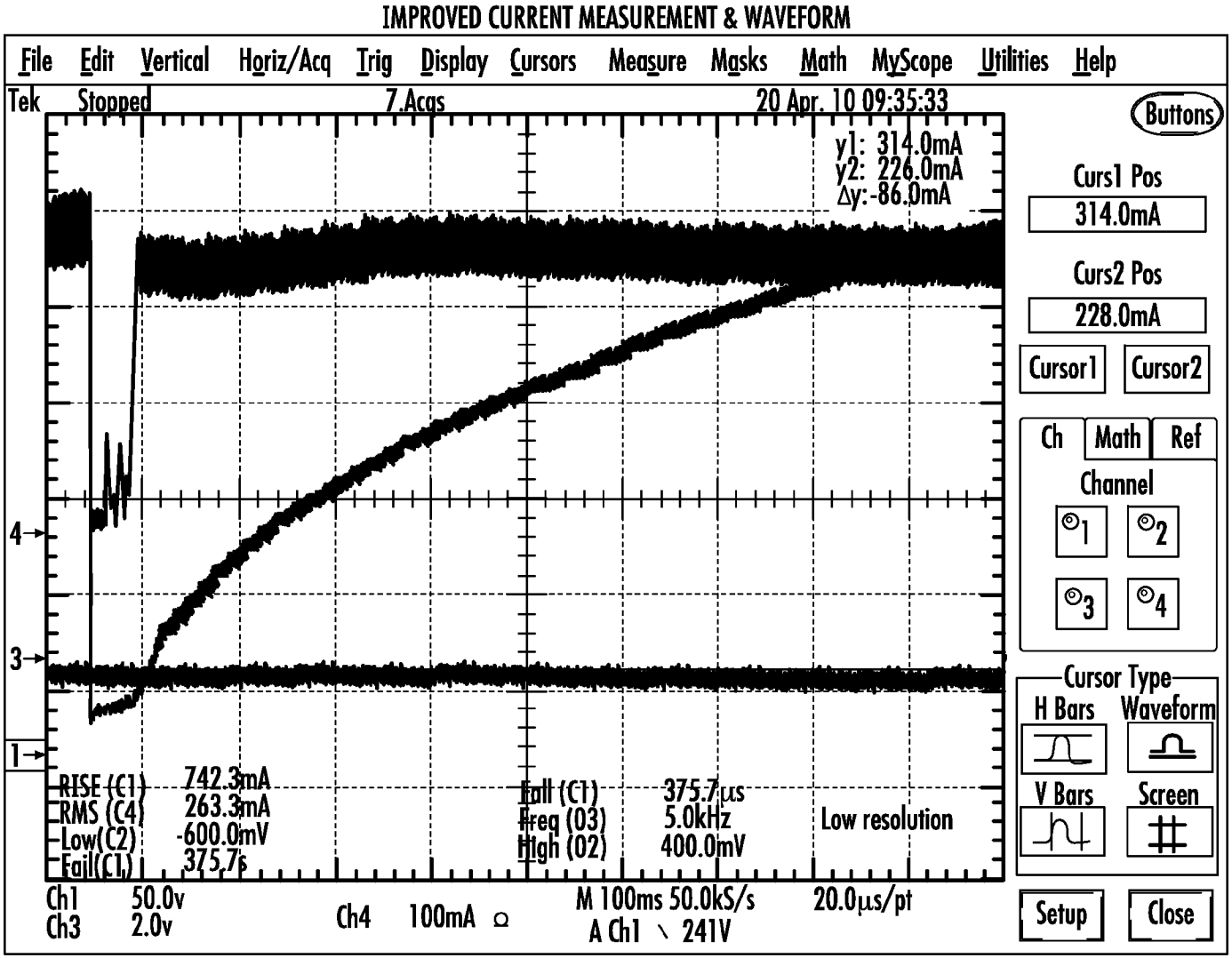
Figure 7A:
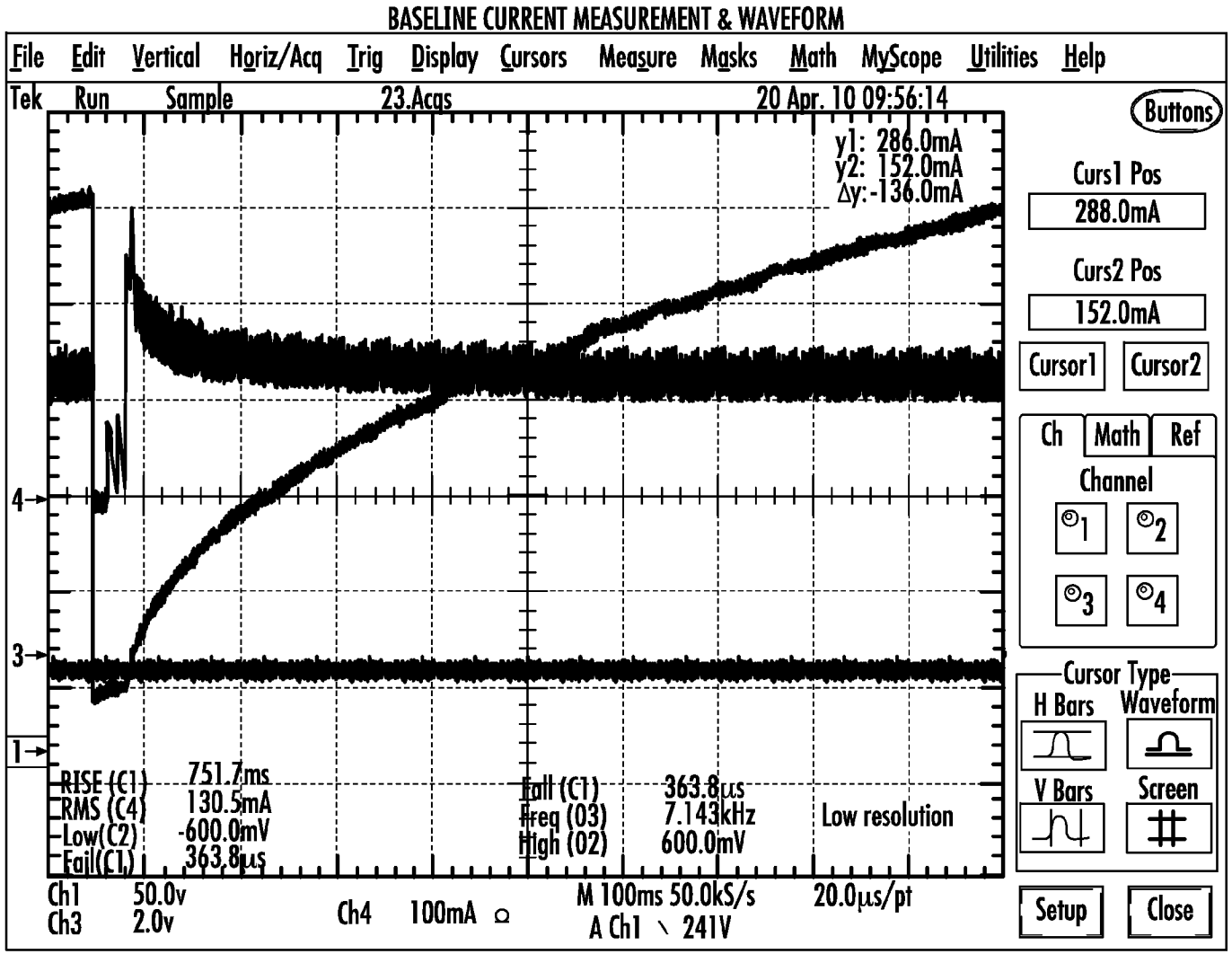
Figure 7B:
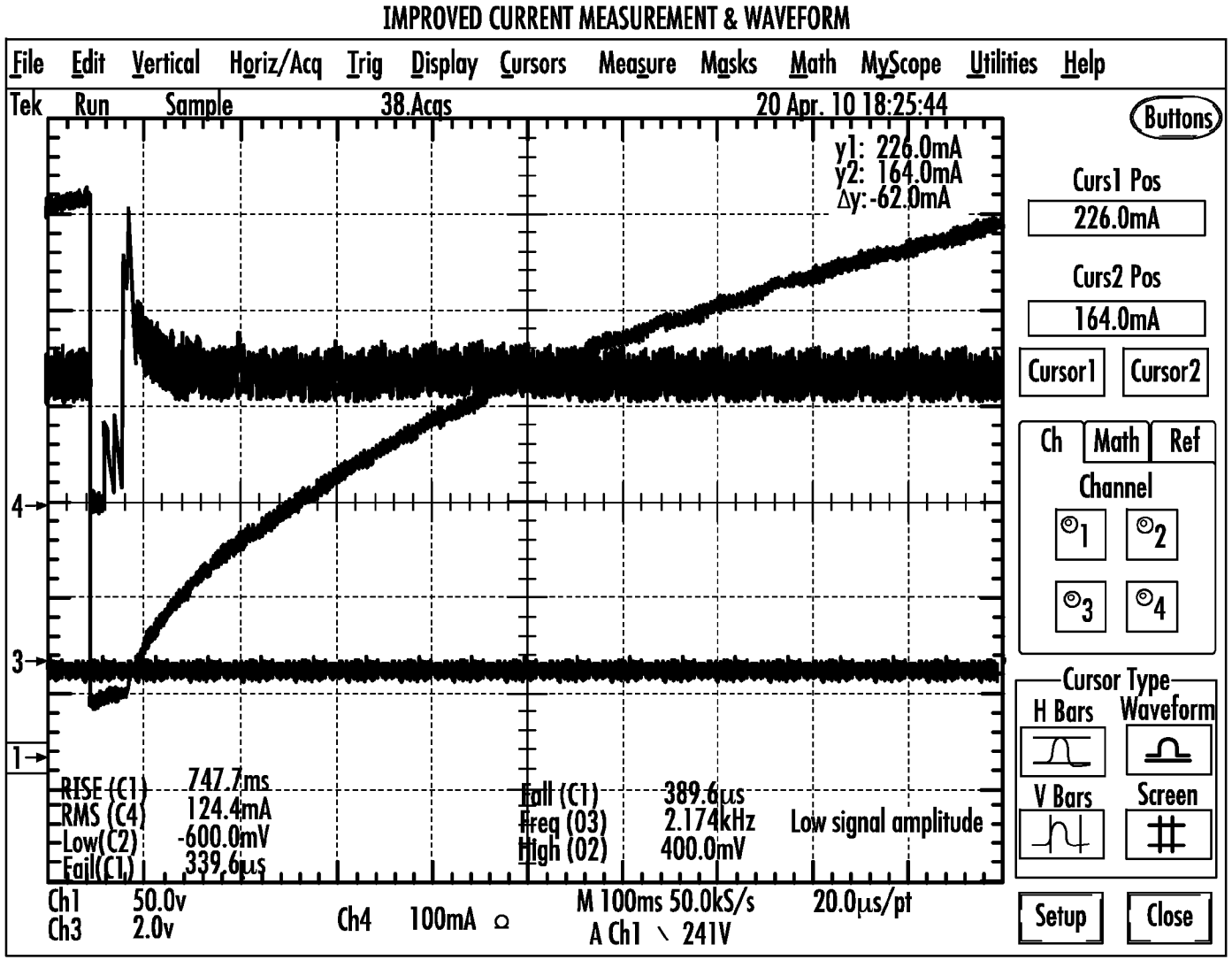

FIGS. 4-7 illustrate waveforms 400-700 respectively. Each set of waveforms 400-700 illustrates a baseline current measurement and waveform for an improved current measurement with the implementation of the preferred embodiment and corresponding data shown in Tables 1-4 above. The baseline current measurements and waveforms represent test results for a notification appliance circuit without a current peaking circuit and improved current measurements and waveforms represent test results for a notification appliance including a current peaking circuit. For example, FIG. 4 is a baseline current measurement and waveform for an input voltage of 16V and a candela level of 15Cd associated with the optical element 114. As can be seen, the peak current is about 90 mA, a steady state current of about 51.2 mA and a delta I (ΔI)=−38.8 mA. This baseline is compared to the improved current measurement where the peak current is 71.2 mA, with a steady state current of 47.6 ma making ΔI=−23.6 mA. As can be seen, the peak current utilizing the current peaking circuit demonstrates a lower peaking current. Similarly, FIG. 5 illustrates the comparison waveforms for an input voltage of 33V and a candela level of 15Cd. FIG. 6 illustrates the comparison waveforms for an input voltage of 16V and a candela level of 185Cd and FIG. 7 illustrates the comparison waveforms for an input voltage of 33V and a candela level of 185Cd. Each of these waveforms demonstrates that the addition of the current peaking circuit to the notification appliance circuit improves the baseline performance of the notification appliance and may reduce current peaking in the circuit.

Figure 8:
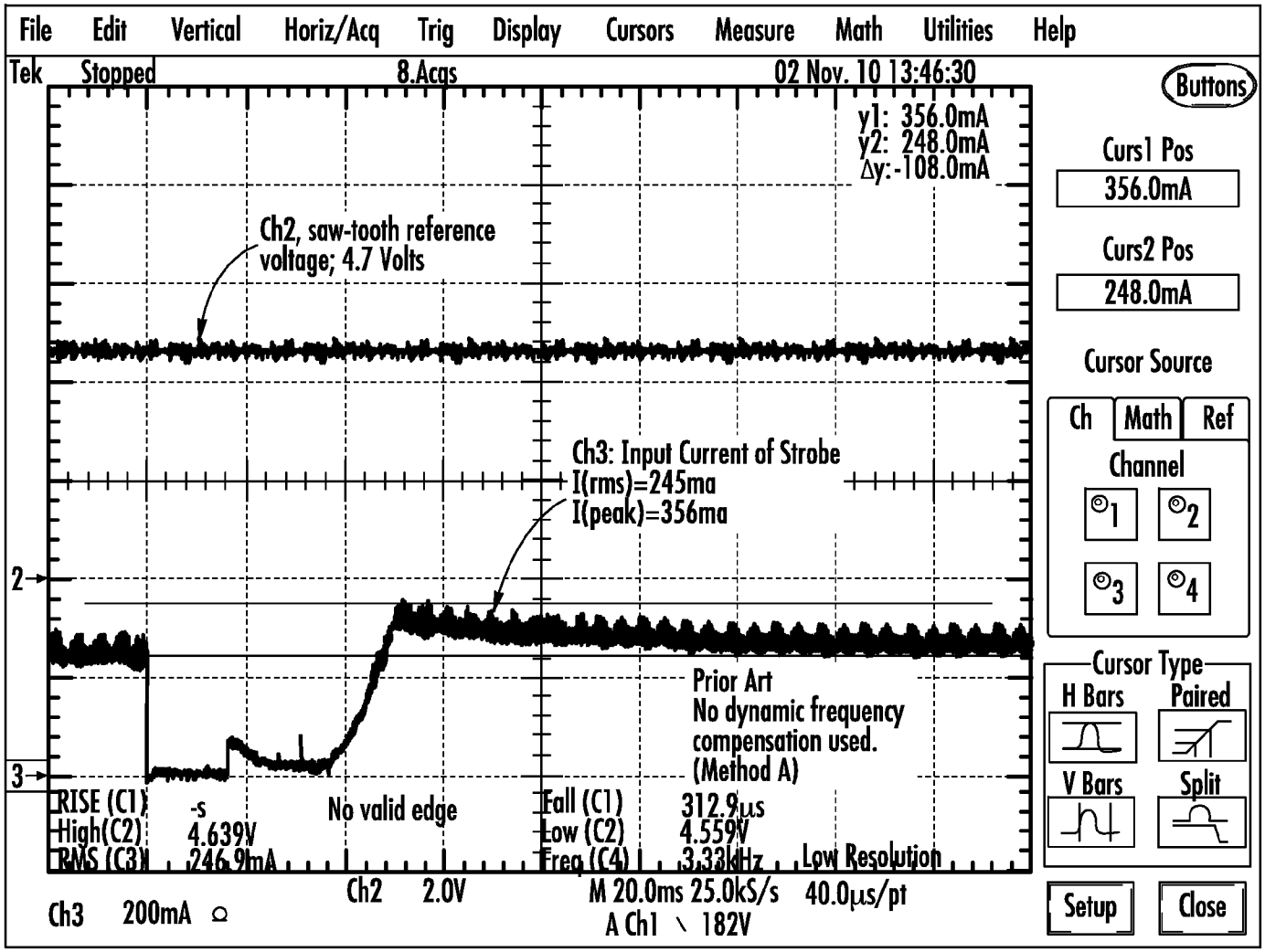
FIGS. 8-12 are waveforms illustrating the behavior of the saw-tooth reference voltage prior to and after implementation of dynamic frequency compensation.
Figure 9:
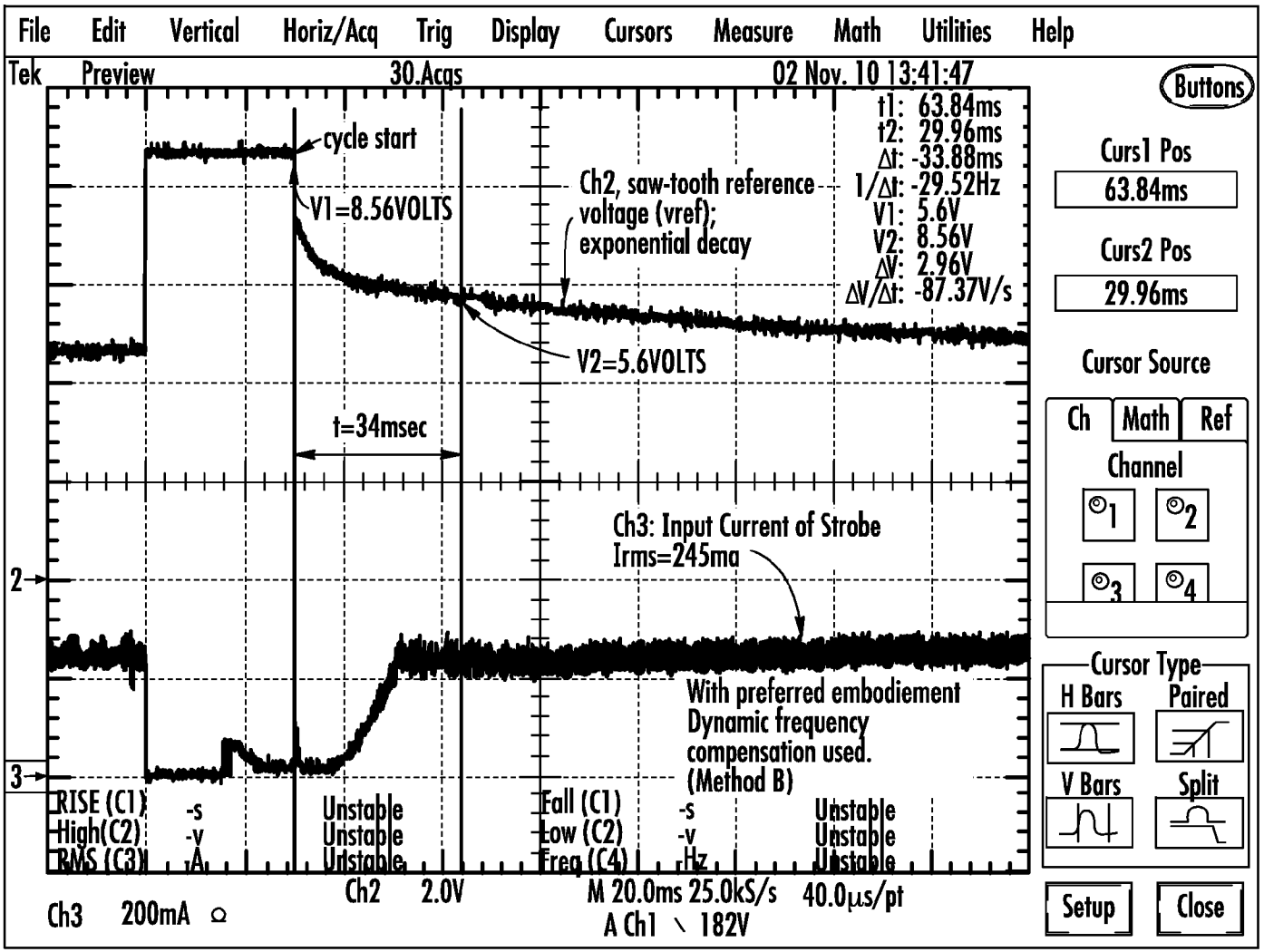
Figure 10:
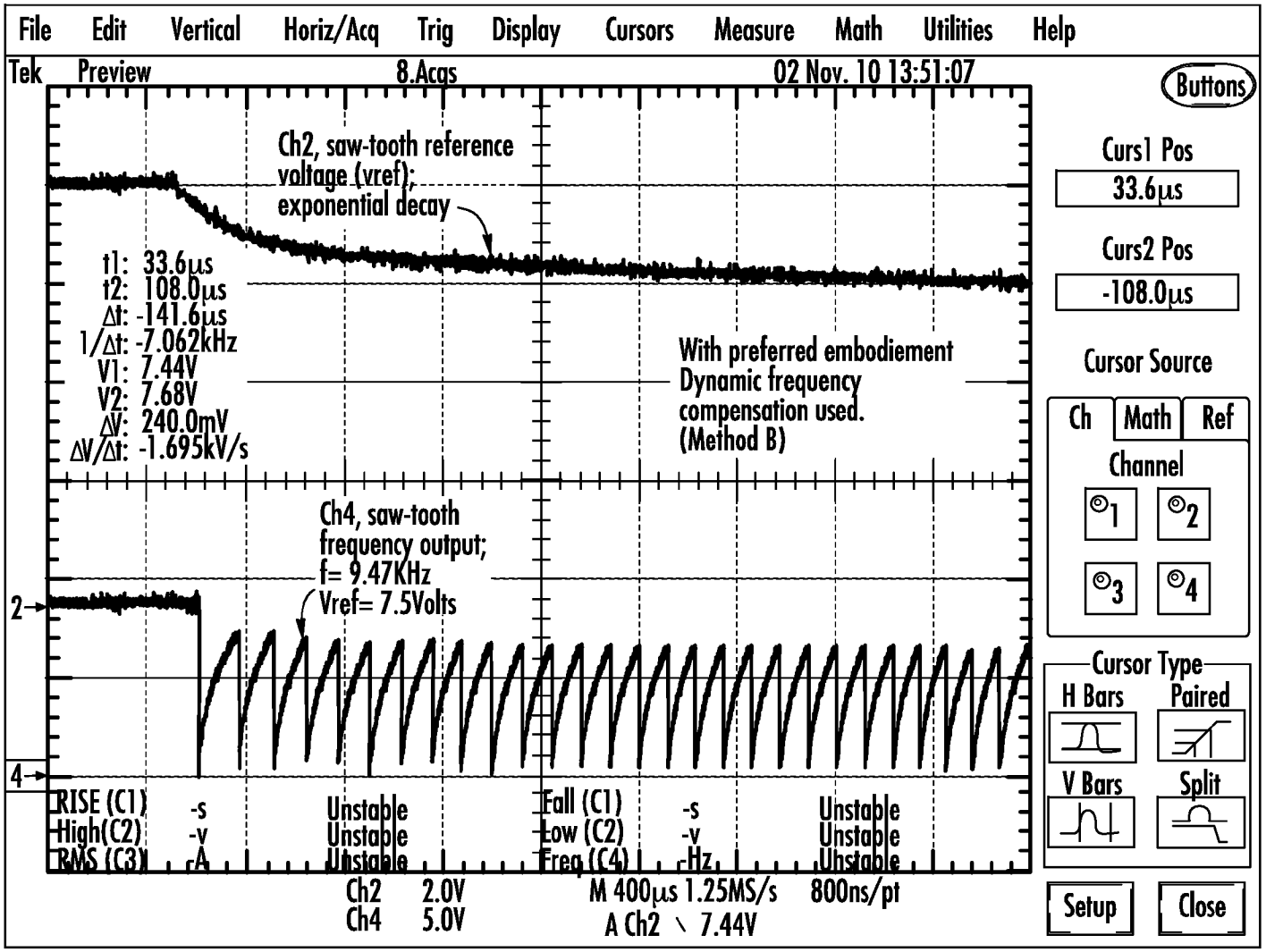
Figure 11:
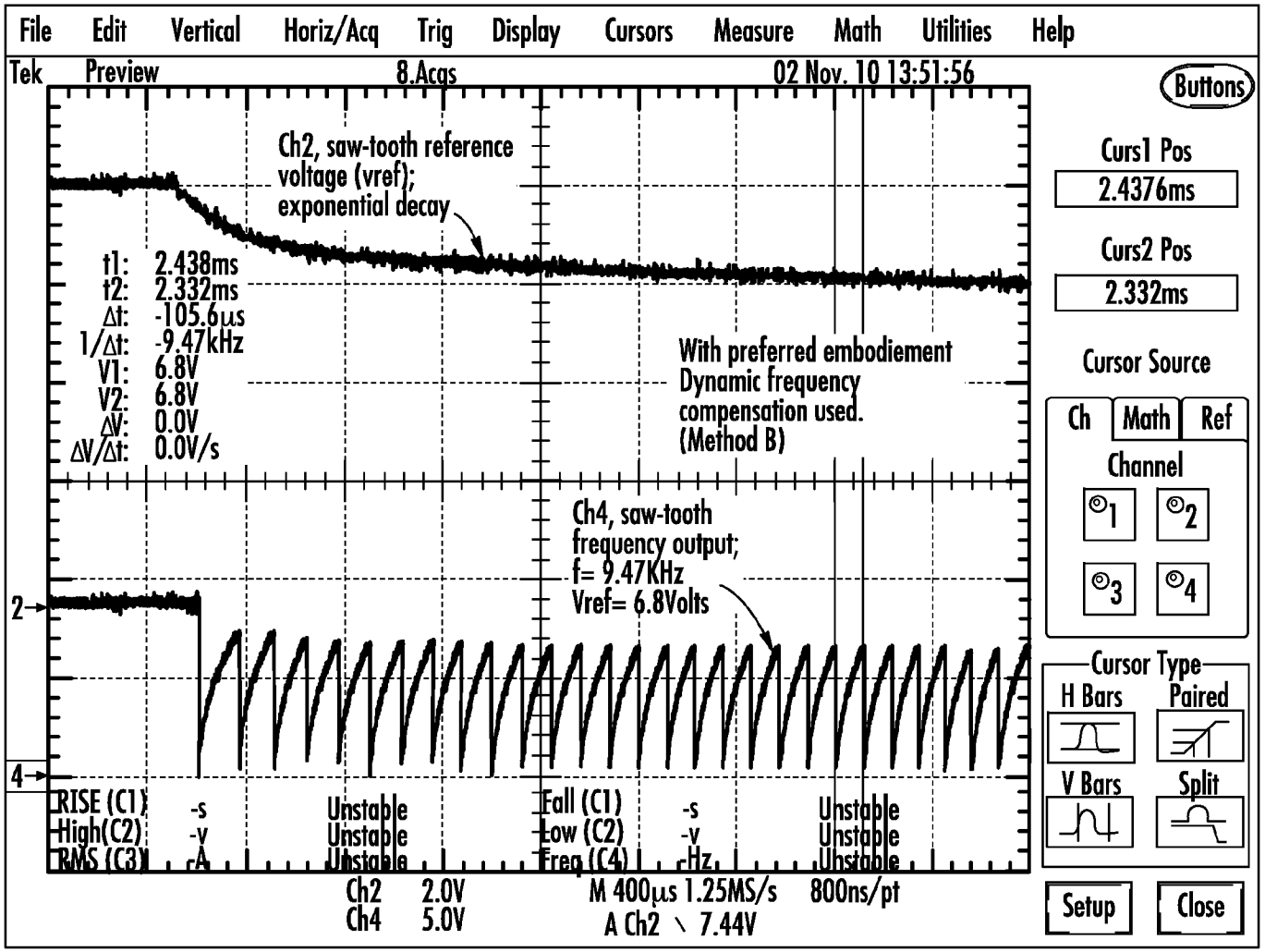
Figure 12:
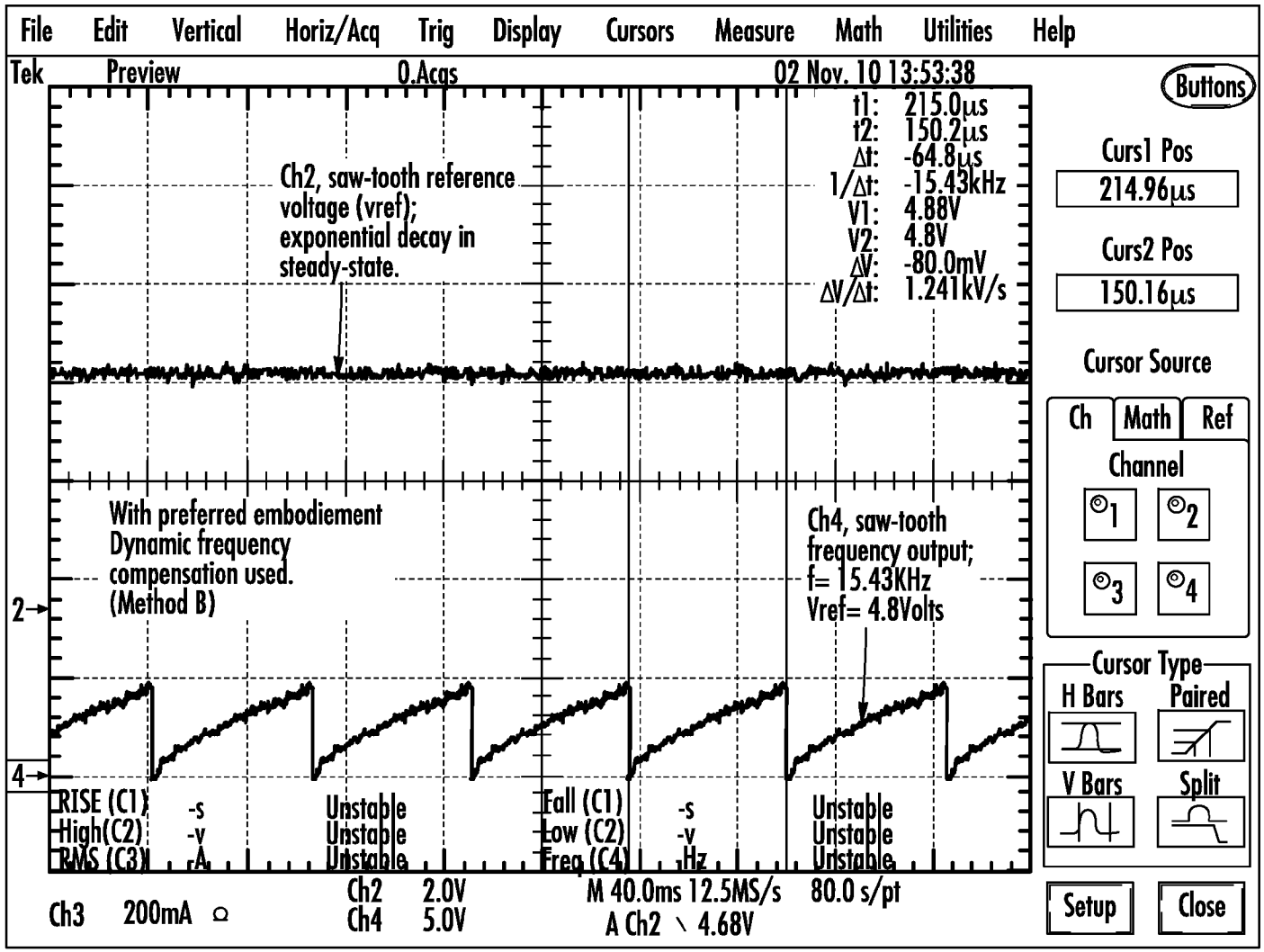

FIGS. 8-12 are waveforms illustrating the behavior of the saw-tooth reference voltage before (FIG. 8) and after (FIGS. 9-12) implementation of the dynamic frequency compensation circuit in accordance with the present invention from start-up to the decay curve and then in its steady-state of operation. In particular, FIG. 8 illustrates saw-tooth reference voltage signal at about 4.7 volts and an input current to the strobe optical element with $I_{rms}$=245 ma and $I_{peak}$=356 ma. As can be seen, the input current peaks and then levels-off. Whereas FIG. 9 illustrates waveforms utilizing the dynamic frequency compensation circuit of the present invention. As can be seen, the cycle starts at voltage V1=8.56 volts to V2=5.6 volts during t=34 msec with exponential decay of the saw tooth reference voltage $V_{ref}$. The input current to the strobe optical element is $I_{rms}$=245 ma. By utilizing the dynamic frequency compensation circuit, current peaking shown in FIG. 8 is avoided. FIGS. 10 and 11 again illustrates the saw-tooth reference voltage $V_{ref}$ with exponential decay with the saw-tooth frequency output F=9.47 Khz at $V_{ref}$=7.5 volts in FIGS. 10 and $V_{ref}$=6.8 volts in FIG. 11. FIG. 12 illustrates the saw-tooth reference voltage $V_{ref}$ and the associated exponential voltage decay in steady state and the corresponding saw-tooth frequency output of F=15.43 KHz with $V_{ref}$=4.8 volts. These figures further illustrate reduction in current peaking by the use of the dynamic frequency compensation circuit.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A current peaking compensation circuit, comprising:

a first transistor;

a first capacitor coupled to the first transistor wherein a gain of the first transistor is multiplied by a capacitance of the first capacitor to generate a time constant for the current peaking compensation circuit; and a resistor divider circuit electrically coupled to said first transistor, wherein the current peaking compensation circuit is configured to reduce a start-up frequency of a pulse-width modulated signal during a first time period and to add a time constant decaying voltage across the resistor divider network to increase a reference voltage during the first time period.

2. The current peaking compensation circuit of claim 1, comprising a second transistor coupled to the first capacitor and the first transistor, said second transistor configured to discharge the first capacitor after the first time period.

3. The current peaking compensation circuit of claim 1, wherein the first time period comprises a start-up time of the pulse-width modulated signal.

4. The current peaking compensation circuit of claim 1, wherein the time constant decaying voltage comprises an exponentially decaying voltage configured to decay from a rail voltage to a reference voltage.

5. The current peaking compensation circuit of claim 1, wherein the pulse-width modulated signal is configured to periodically turn on and off an optical element of a notification appliance, wherein the optical element comprises a xenon bulb or strobe.

6. A notification appliance, comprising:

one or more optical elements;

an optical element driving circuit electrically communicating with said one or more optical elements and configured to drive the one or more optical elements; and a current peaking circuit electrically communicating with said driving circuit and configured to reduce a start-up frequency of a pulse-width modulated signal during a first time period to enable substantially constant current operation of the notification appliance.

7. The notification appliance of claim 6, wherein the current peaking circuit is configured to add a time constant decaying voltage across a resistor divider network to increase a reference voltage during the first time period, wherein the first time period comprises a start-up time of the pulse-width modulated signal.

8. The notification appliance of claim 7, wherein the time constant decaying voltage comprises an exponentially decaying voltage configured to decay from a rail voltage to a reference voltage.

9. The notification appliance of claim 6, wherein the current peaking circuit comprises:

a first transistor having an emitter, a base and a collector, the first transistor is an NPN transistor configured as a capacitance multiplier; and a second transistor configured to reset a first capacitor after the first time period, wherein the second transistor comprises a PNP transistor having an emitter, a base and a collector, wherein the collector of the second transistor is coupled to the first capacitor and the base of the first transistor.

10. The notification appliance of claim 9, wherein a gain of the first transistor is multiplied by a capacitance of the first capacitor coupled to the base of the first transistor to generate an amplified time constant for the current peaking circuit.

11. The notification appliance of claim 9, wherein a collector resistor is used on the first transistor, to control the amplitude of the saturated output reference voltage.

12. The notification appliance of claim 6, wherein the pulse-width modulated signal is generated by the optical element driving circuit and is configured to periodically turn on and off the one or more optical elements of the notification appliance, wherein the one or more optical elements comprise one or more xenon bulbs or strobes.

13. A system, comprising:

one or more current regulated power supplies; and a plurality of notification appliances, wherein one or more of the notification appliances comprises a current peaking circuit, the current peaking circuit configured to reduce a start-up frequency of a pulse-width modulated signal during a first time period to enable substantially constant current regulated operation of the notification appliance without adversely affecting current output nor affect the amount of output power delivered.

14. The system of claim 12, wherein the current peaking circuit is configured to add a time constant decaying voltage across a resistor divider network to increase a reference voltage during the first time period, wherein the first time period comprises a start-up time of the pulse-width modulated signal, wherein the time constant decaying voltage comprises an exponentially decaying voltage configured to decay from a rail voltage to a reference voltage.

15. The system of claim 12, wherein the current peaking circuit comprises a first transistor having an emitter, a base and a collector, the first transistor comprising an NPN transistor configured as a capacitance multiplier wherein a gain of the first transistor is multiplied by a capacitance of a first capacitor coupled to the base of the first transistor to generate a time constant for the current peaking circuit.

16. The system of claim 14, wherein the current peaking circuit comprises a second transistor configured to reset the first capacitor after the first time period, wherein the second transistor comprises a PNP transistor having an emitter, a base and a collector, wherein the collector of the second transistor is coupled to the first capacitor and the base of the first transistor.

17. The system of claim 12, wherein the pulse-width modulated signal is generated by an optical element driving circuit and is configured to periodically turn on and off one or more optical elements of the notification appliance, wherein the one or more optical elements comprise one or more xenon bulbs or strobes.

* * * * *